United States Patent [19]

Nakanishi et al.

[11] 4,395,226

[45] Jul. 26, 1983

[54] COMBUSTION SAFETY APPARATUS

[75] Inventors: Masakatsu Nakanishi; Toshiyuki Nomura, both of Nagoya, Japan

[73] Assignee: Rinnai Kabushiki Kaisha, Nagoya, Japan

[21] Appl. No.: 178,346

[22] Filed: Aug. 14, 1980

[30] Foreign Application Priority Data

Aug. 20, 1979 [JP] Japan ..... 54/104995

[51] Int. Cl.[3] ..... F23N 5/00

[52] U.S. Cl. ..... 431/76; 431/116; 236/15 E; 204/421

[58] Field of Search ..... 431/75, 76, 116; 73/23, 73/27 R; 340/577, 579; 204/195 S, 1 T; 200/61.03; 236/15 E; 122/504

[56] References Cited

U.S. PATENT DOCUMENTS 4,032,286 6/1977 Kobayashi et al. ..... 431/76
4,125,356 11/1978 Ohashi et al. ..... 431/76

FOREIGN PATENT DOCUMENTS 1143955 2/1963 Fed. Rep. of Germany ..... 431/76

*Primary Examiner*—Samuel Scott
*Assistant Examiner*—Lee E. Barrett
*Attorney, Agent, or Firm*—Armstrong, Nikaido, Marmelstein & Kubovcik

[57] ABSTRACT

A combustion safety apparatus wherein combustion exhaust gas of a burner is arranged to be introduced into a detecting tube having a tubular oxygen concentration cell element, and a safety valve is arranged to be controlled in operation by the output of the cell element. The detecting tube is in communication at its outlet opening with a mixing tube of the foregoing burner or another burner.

3 Claims, 5 Drawing Figures

COMBUSTION SAFETY APPARATUS

BACKGROUND OF THE INVENTION

This invention relates to a combustion safety apparatus for preventing occurrence of an accident caused by lack of oxygen.

As for an apparatus of this kind, there has been hitherto known such a type one that an oxygen concentration in combustion exhaust gas of a burner is monitored by an oxygen concentration cell element such as zirconia or the like, so that when the oxygen concentration in the combustion exhaust gas is lowered as a result of incomplete combustion of the burner made at the time of lack of oxygen, a safety valve interposed in a gas supply pipe is closed by an output of the element. It can be considered, in this type of apparatus, that in order that combustion exhaust gas may be securedly brought into contact with the element, a detecting tube for introducing the combustion exhaust gas is provided, and that the element formed as a tubular element is interposed in the detecting tube. In this arrangement, it is desirable that the combustion exhaust gas should flow in a stable condition through the detecting tube.

SUMMARY OF THE INVENTION

This invention has for its object to provide an apparatus which can meet this desire, and in an apparatus of the type that combustion exhaust gas of a main burner or of a pilot burner is introduced into a detecting tube, and a tubular oxygen concentration cell element having electrodes on its inner and outer surfaces is interposed in the detecting tube, and a safety valve interposed in a gas supply pipe is controlled in operation by an output of the element, it is characterized in that an outlet opening of the detecting tube is in communication with a mixing tube of the main burner or of the pilot burner.

BRIEF DESCRIPTION OF THE DRAWINGS

This invention will now be described with reference to the accompanying drawings, in which.

DESCRIPTION OF THE PREFERRED EMBODIMENT

Figure 1:
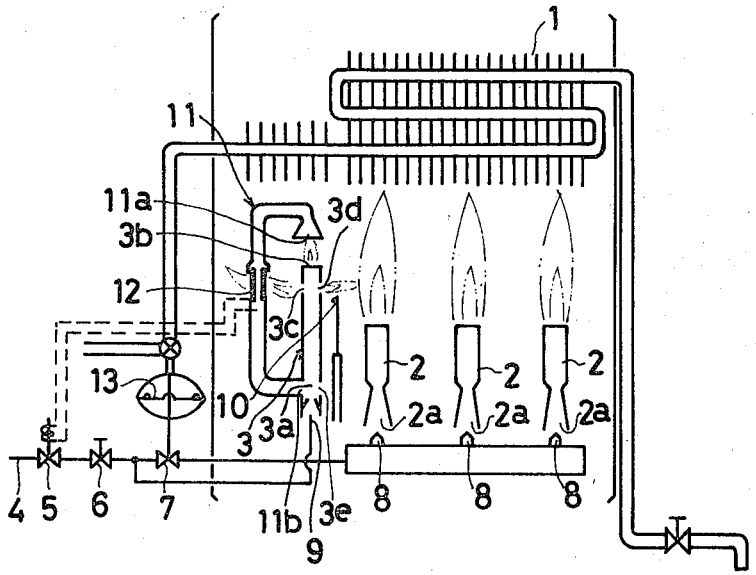
FIG. 1 is a sectional side view of a gas appliance having this invention apparatus.

Embodying examples of this invention will now be explained with reference to the accompanying drawings:

FIG. 1 shows a gas water heater having this invention apparatus, and the water heater is provided with a heat exchanger 1 on its upper side, plural main burners 2 which are lined up below the heat exchanger 1, and a pilot burner 3 disposed on one side of the main burners 2. A safety valve 5, a gas cock 6 and a water pressure responsive valve 7 are interposed in order in a gas supply pipe 4 connected to a gas supply source (not shown), and gas nozzles 8 opened, respectively, to mixing tubes 2*a* of the main burners 2 are connected to such a portion of the gas supply pipe 4 that is located on the downstream side of the water pressure responsive valve 7, and a gas nozzle 9 opened to a mixing tube 3*a* of the pilot burner 3 is connected at its branch pipe to such a portion of the pipe 4 that is located between the water pressure responsive valve 7 and the gas cock 6 and by operation of the gas cock 6 the safety valve 5 is forced to open and spark discharge of an ignition electrode 10 located in opposite to the pilot burner 3 is made and thereby the pilot burner 3 is ignited, and if, thereafter, the heat exchanger 1 is supplied with water, the water pressure responsive valve 7 is opened and thereby the main burners 2 are caught fire from the pilot burner 3.

Referring to the drawings, numeral 11 denotes a detecting tube and numeral 12 denotes a tubular oxygen concentration cell element interposed in the detecting tube 11.

In an example shown in FIG. 1, the detecting tube 11 is disposed on one side of the pilot burner 3 so as to be in parallel with the same, and a hat-shaped inlet opening 11*a* of the upper end of the detecting tube 11 is positioned above a flame opening 3*b* made especially for detecting in the upper end of the pilot burner 3, and an outlet opening 11*b* of the lower end of the detecting tube 11 is connected to be in communication with the mixing tube 3*a* of the pilot burner 3 so that the combustion exhaust gas in the detecting tube 11 may be so drawn and forced to flow back to the mixing tube 3*a* of the pilot burner 3 through the tube 11 by projection of gas from the gas nozzle 9 opened to the mixing tube 3*a*.

Figure 2:
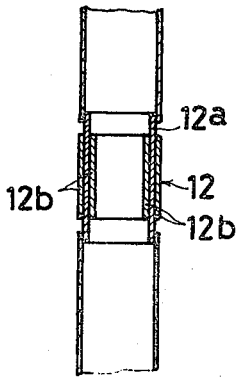
FIG. 2 is an enlarged sectional side view of an oxygen concentration cell element section thereof.

As shown clearly in FIG. 2, the oxygen concentration cell element 12 is so constructed that porous electrodes 12*b*, 12*b* of platinum or the like are formed on inner and outer surfaces of a tubular sintered body 12*a* of oxygen ion conductive solid electrolyte such as zirconia or the like. The element 12 is so high in its internal resistance at a room temperature as not to generate an electromotive force but, when heated to a predetermined operation temperature, is so reduced in its internal resistance as to generate an electromotive force corresponding to the difference in the oxygen concentrations in the inner and outer atmosphere gases which are in contact with the inner and outer electrodes 12*b*, 12*b*. In the example shown in FIG. 1, the element 12 is arranged to be enveloped in and heated by a combustion flame spurting from a flame opening 3*c* made in one side wall of the pilot burner 3.

Referring to the drawings, numeral 3*d* denotes a conventional flame opening made in the other side wall of the pilot burner 3 for setting fire to the main burners 3, and numeral 3*e* denotes a primary air opening made in the mixing tube 3*a* of the pilot burner 3, and numeral 13 denotes a diaphragm for operating the water pressure responsive valve 7.

MODE OF OPERATION

Next, the operation of the apparatus will be explained as follows:

First, the oxygen concentration cell element 12 is in such a use condition that the outer surface electrode 12*b* is enveloped in the combustion flame from the flame opening 3*c* and consequently is situated in a comparatively low oxygen concentration atmosphere, while the inner surface electrode 12*b* is situated in a comparatively high oxygen concentration atmosphere of the exhaust gas because the oxygen concentration in the combustion exhaust gas at the time of a normal combustion of the pilot burner 3 is remained in a comparatively high concentration condition, and when the element 12 is heated to a predetermined operation temperature, there is generated an electromotive force corresponding to the difference between the oxygen concentrations at the inner and outer electrodes 12*b*, 12*b*, and thereby the safety valve 5 is kept in its valve open condition. If an atmosphere around the burner 3 becomes an oxygen lack condition, the oxygen concentration in the combustion exhaust gas is decreased, so that the difference between the oxygen concentrations at the two electrodes 12*b*, 12*b* is decreased, and thereby the electric power is lowered to a certain valve, so that the safety valve 5 is closed. In general, the sensitivity of the oxygen concentration cell element 12 in response to a change in the difference between oxygen concentrations at the two electrodes 12*b*, 12*b* is very high. Therefore, if it is now assumed that the combustion exhaust gas flows through the detecting tube 11 in an unstable condition with its pulsatory motion, undulatory motion or the like, there is such a possibility that the element 12 detects a partially lowered oxygen concentration condition of the exhaust gas and the safety valve 5 is unexpectedly closed.

With this invention arrangement, however, the combustion exhaust gas introduced in the tube 11 is drawn by the gas projection from the gas nozzle 9 so as to be forcibly flown through the detecting tube 11 and the gas flows in a stable condition, so that there is eliminated such an unfavorable possible happening as above.

Additionally, in the example shown in FIG. 1, since the combustion exhaust gas of the pilot burner 3 is forced to flow to return to the pilot burner 3, even when the oxygen concentration in the combustion exhaust gas is slightly lowered as there is a lack of oxygen, the oxygen concentration in the combustion exhaust gas produced by combustion of the mixture gas caused by using the returning combustion gas as a part of the primary air is largely lowered and consequently the detection of the oxygen lack condition can be carried out at a higher sensitivity.

If a gas which is large in lifting property is used, it often happens that the combustion flame is blown off at the time of lack in oxygen. In this case, the heating of the oxygen concentration cell element 12 by the combustion flame is stopped, so that the electromotive force is lowered as a result of cooling of the element 12 and consequently the safety valve 5 is closed, and thus safety is ensured.

Figure 3:
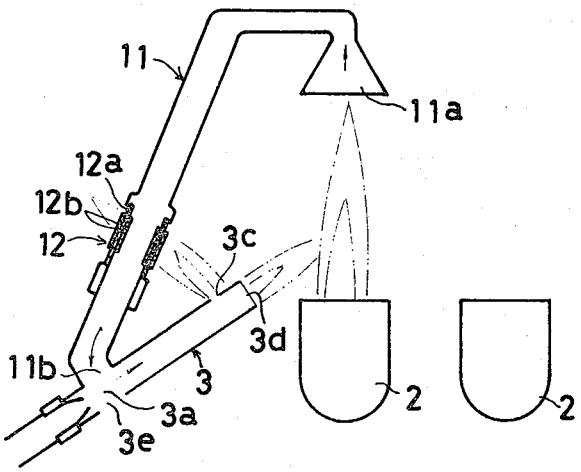
FIG. 3 is a sectional side view of an important section showing a modified example of this invention apparatus.

The above explanation is about such an example that the combustion exhaust gas of the pilot burner 3 is forced to flow back to the pilot burner 3 through the detecting tube 11, but this invention is not limited to this example and such a modification can be considered, for instance, that, as shown in FIG. 3, the combustion exhaust gas of the main burner 2 is forced to flow back to the pilot burner 3 through the detecting tube 11.

Figure 4:
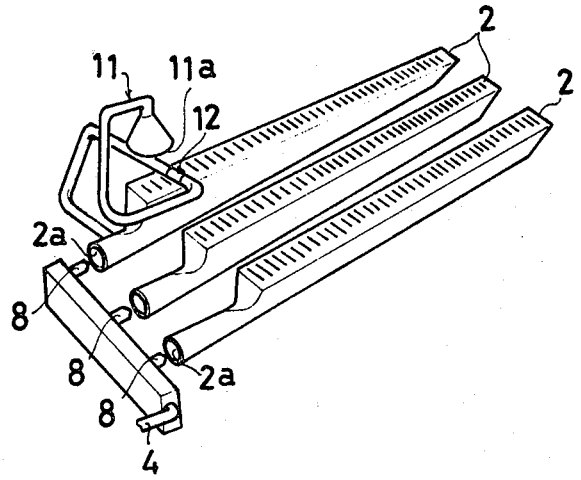
FIG. 4 is a perspective view showing another modified example of this invention apparatus.

Additionally, in such a type of gas appliance as a bath boiler or the like in which the main burner 2 is continued to be operated, such a modification can be considered that, for instance, that, as shown in FIG. 4, the combustion exhaust gas of the main burner 2 is returned to the main burner 2 after flowing through the detecting tube 11.

Figure 5:
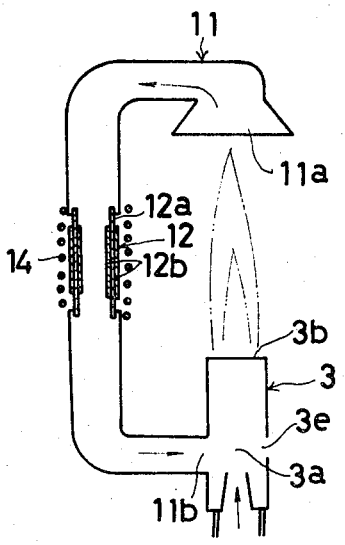
FIG. 5 is a sectional side view of an important section showing further another modification thereof.

In the foregoing examples, the oxygen concentration cell element 12 is enveloped in and heated to the operable temperature by the combustion flame of the main burner 2 or that of the pilot burner 3, but this invention is not limited to those and such a modification, for example, can be considered that, as shown in FIG. 5, the oxygen concentration cell element 12 is heated by an electric heater 14, and the outer surface electrode 12*b* is always in contact with the atmospheric air and accordingly is brought in a comparatively high oxygen concentration atmosphere of the air, and consequently when an electromotive force is generated on increasing in the difference between oxygen concentrtions at the two electrodes 12*b*, 12*b* by lowering of the oxygen concentration in the combustion exhaust gas as there occurs a lack of oxygen, the safety valve is closed.

Thus, according to this invention, the outlet opening of the detecting tube is in communication with the mixing tube of the pilot or main burner and the combustion exhaust gas introduced into the detecting tube is drawn forcibly therethrough to flow back to the mixing tube thereof by the gas projection from the gas nozzle toward the mixing tube, so that the flow thereof through the detecting tube can become in a stable condition, regardless of a length or a shape of the detecting tube, and accordingly the oxygen concentration in the combustion exhaust gas can be always monitored accurately or reliably by the tubular oxygen concentration cell element interposed in the detecting tube, and the safety valve can be closed as the oxygen concentration in the combustion exhaust gas is actually lowered as a result of an oxygen lack atmosphere, and there can be obtained an apparatus high in sensitivity and excellent in safetiness.

What is claimed is:

1. A combustion safety apparatus for controlling operation of a burner by monitoring combustion exhaust gas of said burner comprising:

a detecting tube positioned adjacent said burner receiving exhaust gas into an inlet thereof, said burner having gas supply pipe, and an inlet mixing tube, said detecting tube having an outlet in communication with said mixing tube of said burner, a tubular oxygen concentration cell element having electrodes on its inner and outer surfaces, said cell element being interposed in said detecting tube, a difference in oxygen concentrations at each of said electrodes producing a certain output when said cell element is heated to a high temperature, means for heating said cell element to said high temperature, and safety valve means in said gas supply pipe and connected to said cell element for shutting off gas supply to said burner when said cell element produces less than said certain output.

2. A combustion safety apparatus as claimed in claim 1, wherein said means for heating the cell element is a combustion flame of said burner impinging on said outer surface.

3. A combustion safety apparatus as claimed in claim 1, wherein said means for heating the cell element is an electric heater.

* * * * *